United States Patent [19]

Tomlinson, II

[11] 4,190,490

[45] Feb. 26, 1980

[54] IMPREGNATION AND DIGESTION OF WOOD CHIPS

[75] Inventor: George H. Tomlinson, II, Ile Perrot, Canada

[73] Assignee: Domtar Inc., Montreal, Canada

[21] Appl. No.: 573,558

[22] Filed: May 1, 1975

Related U.S. Application Data

[63] Continuation-in-part of Ser. No. 457,453, Apr. 3, 1974, abandoned.

[51] Int. Cl.[2] ..... D21C 1/02; D21C 3/22

[52] U.S. Cl. ..... 162/19; 162/38; 162/57; 162/243

[58] Field of Search ..... 162/17, 19, 37, 38, 162/52, 56, 235, 57, 24, 71, DIG. 2, 237, 242, 243, 244

[56] References Cited

U.S. PATENT DOCUMENTS

| | | | |
|---|---|---|---|
| 51,705 | 12/1865 | Dixon | 162/57 |
| 889,241 | 6/1908 | Kennedy | 162/235 |
| 2,007,348 | 7/1935 | Scharmann et al. | 162/24 X |
| 2,516,447 | 7/1950 | Burling et al. | 162/57 |
| 2,733,992 | 2/1956 | Reyerson | 162/57 |
| 2,858,211 | 10/1958 | Durant et al. | 162/19 X |
| 3,311,530 | 3/1967 | Justus et al. | 162/19 |
| 3,313,677 | 4/1967 | Carr | 162/19 |
| 3,326,743 | 6/1967 | Bryce | 162/19 |
| 3,441,475 | 4/1969 | Tomlinson | 162/19 |
| 3,525,665 | 8/1970 | Gessner | 162/19 X |
| 3,532,594 | 10/1970 | Richter | 162/19 |
| 3,619,348 | 11/1971 | Asplund et al. | 162/19 |
| 3,802,956 | 4/1974 | Backlund | 162/19 |

FOREIGN PATENT DOCUMENTS

| | | | |
|---|---|---|---|
| 721960 | 11/1965 | Canada | 162/19 |

*Primary Examiner*—Arthur L. Corbin
*Attorney, Agent, or Firm*—C. A. Rowley

[57] ABSTRACT

A mixture of wood chips and impregnation liquor is continuously passed through an impregnation zone, the mixture is agitated throughout said impregnation zone to maintain the consistency of the mixture constant and the residence time of the chips uniform throughout said impregnation zone, the mixture is withdrawn from said impregnation zone, excess liquor is removed from the chips and said chips are then digested in a cooking zone.

10 Claims, 1 Drawing Figure

IMPREGNATION AND DIGESTION OF WOOD CHIPS

This application is a continuation in part of U.S. application Ser. No. 457,453 filed Apr. 3, 1974 and now abandoned.

FIELD OF THE INVENTION

The present invention relates to the impregnation of wood particles or like lignocellulosic material. It relates more particularly to the impregnating of small particles of lignocellulose material for subsequent conversion to pulp.

DESCRIPTION OF THE PRIOR ART

As a first stage in the production of pulp, wood has been conventionally reduced to particles referred to as chips. These chips are produced by the action of knives which cut the log at an angle and reduce it to lengths that may be set in the range of ⅝" to 1¼" but are normally set to about ¾". The wedge action of the knife results in splitting of the wood with the grain, and the thickness and width of these chips are somewhat random, the thickness being in the range of about 1½ mm to as much as 8 mm. In addition, splinters and 'chipper dust' are formed in variable amounts depending on sharpness of knives, wood moisture and other factors.

The digestion stage consists of treating the chips at elevated temperature and pressure with a solution of a chemical capable of dissolving the lignin and other materials which bind the fibres together in the wood structure. In the kraft process, the digestion chemical consists of a solution of sodium hydroxide and sodium sulfide. This digestion liquor is obtained by a recycling process which involves evaporation and combustion of the residual liquor followed by treatment of a solution of the inorganic combustion residue with lime. With batch digestion and using chips produced from spruce approximately 16 grams of 'effective alkali' expressed as $Na_2O$ are required per 100 grams dry weight of wood. The concentration of effective alkali (i.e. the sum of $NaOH+\frac{1}{2}\ Na_2S$) expressed as $Na_2O$ in the cooking liquor is normally about 90 grams per liter, and in this case 178 cc of liquor are therefore required per 100 grams wood.

If the wood contains 50% moisture, the total volume of liquid, including the water in the wood, is 178=100=278 cc per 100 g wood. Because of the porous nature of wood, about 200 cc can be held within 100 grams of the wood structure. When the digestion liquor is added to the chips, the alkali is strongly absorbed by the chips first contacted and it has been found that in order to at least partially equalize the distribution of chemical throughout the chip mass, good circulation is required. It has been found that in order to establish adequate circulation for this purpose, a total volume of approximately 400 cc total liquid per 100 grams chips is necessary. Since the reagent plus initial moisture in the chips is 278 cc, an additional 122 cc of dilution liquid is necessary and residual liquor from a previous cook is normally used. Digestion is carried out at elevated temperature, i.e. approximately 175° C. About one half of the digestion chemical is inside the chips with the balance as 'free' liquor outside. As the alkali inside the chips is depleted through reaction with lignin and other wood substances, it is replenished in part by diffusion of alkali from the surrounding liquor. The rate of pulping by this method is controlled by the rate of diffusion of chemical into the chips during digestion. The total time for batch digestion for the production of bleachable kraft pulp is approximately 1 hour for bringing to temperature and a further hour and 30 minutes to complete the digestion.

Conventional continuous pulping systems such as a Kymar system are essentially adaptations of the batch system.

An improved method of pulping has been described by Tomlinson (Canada Patent No. 721,960 issued Nov. 23, 1965) whereby the chips are first continuously impregnated by recycling an impregnation liquor through a mass of chips in an impregnating zone at a temperature below the cooking temperature (i.e. at 150° C.), such that the chips are impregnated with an adequate amount of chemical to complete the pulping. The chips are then lifted from the impregnating liquor and are dropped into a cooking zone where the digestion is carried out in the absence of free liquor at a temperature of 180° C. in a time of 15 to 25 minutes. This rapid digestion time is possible because all of the chemical is in place in the chips before the digestion commences, with the result that the slow diffusion from the surrounding liquor as the chemical is depleted, which is characteristic of conventional pulping, is not a factor. In addition, less effective alkali is normally required, i.e. approximately 13% to 14% versus 15% to 16% for conventional production of chemical pulp. The low liquor to wood ratio in the digestion, as compared to conventional pulping, results in a lower steam requirement for cooking, and the resultant higher concentration of dissolved solids in the residual liquor results in a decreased steam requirement for evaporation in the chemical plant. The lower digestion chemical requirement gives a higher organic to inorganic ratio in the residual liquor which is an advantage in the combustion process involved in recovery.

Special conditions must be maintained in the impregnation zone in order to place sufficient chemical in the chips in order to carry out the digestion. This is accomplished by passing the chips continuously through an impregnation vessel at a controlled rate and contacting them with a liquor which is passed through the vessel at a substantially higher rate, e.g. at a rate 5 to 20 times greater than that of the chips. To accomplish this, impregnation liquor is extracted from the impregnator through a screen and then returned to the impregnator after it has been reinforced with the correct quantity of chemical, e.g. 14% effective $Na_2O$ on wood, and its liquid content has been adjusted so that the net imput of liquid to the impregnation system equals that required to completely saturate the chips. When using wood having normal moisture content, the total liquid imput from the chips plus that of reinforcing chemical liquor is normally greater than that which can be taken up by the chips and the resultant recycled liquor must be partially evaporated as described in the aforesaid patent in order to maintain the correct water balance. Because of the distinct separation of impregnation and digestion steps, only the liquid saturating the chips carries into the digestion stage and therefore the volume of recycled impregnation liquor will increase unless controlled by evaporation. In contrast to this, with the conventional system 'free' impregnation liquor carries directly from the impregnation stage into the digestion stage, and the digestion liquor must be diluted with black liquor in order to have sufficient volume to get adequate circulation for redistribution of alkali during the impregnation stage.

The high rate of liquor circulation i.e. 5 to 20 times greater than the chips results in a relatively small variation in chemical concentration of the liquor entering and leaving the impregnator so that the driving force tending to drive chemical into the chip remains substantially constant throughout the impregnation stage. Moreover the chemical concentration in the impregnator is substantially lower than the incoming white liquor in as much as it is diluted by the relatively large volume ratio of the depleted recycling liquor.

A disadvantage of said Tomlinson digestion process is that thick chips may not be completely impregnated and these can result in reject material such as knotter rejects and shives amounting to 2% to 5% depending on the distribution of chip thickness. With small particles, such as sawdust or normal chips which have been broken down to smaller particles (by passing through an attrition mill or the like) these rejects may be reduced to a low level of less than 1%. Unfortunately, it has not been found possible on an industrial scale to maintain circulation through such wood subdivision because of an increased plugging of the screens after start-up which cannot be reopened on a practical continuous basis by periodic 'back-washing' or other means found effective when dealing with conventional chips.

When wood chips are contacted with an alkaline liquor the alkali is very rapidly absorbed by the chips. In the case of Kraft liquors this results in selective absorption of alkali into and on the chips and the accumulation of sulfide in the impregnation zone. Uniform impregnation of the chips is difficult. The chips which first contact the alkali absorb it avidly causing rapid depletion of the alkali in the liquor and reduced availability of alkali for chips further down along the path of the liquor. Thus some chips will have absorbed too much chemical and some too little and in subsequent cooking some chips will be overcooked and some will not delignify sufficiently. It is for this reason that with conventional pulping of chips the liquor is diluted by the addition of black liquor to permit relative circulation of the liquor through the chip mass and thereby obtain better equalization of chemical. The problem is, or course, aggravated when the chips are small particles of wood, such as sawdust or shavings or chips specially prepared for easy penetration of cooking liquor, such as thin wafers, crushed chips, pin chips, wood chips have been broken down in a disc refiner and the like material. Generally such small chips will have their minimum dimension no greater than 3 mm. Chips of this type, which will be referred to generally herein as small chips, have a large surface in relation to volume and because of the above-mentioned affinity of wood to alkali, will deplete the impregnation liquor particularly rapidly and the difference in concentration of chemical will be very pronounced between one end and the other of the impregnation zone.

In sawdust digesters recirculation of liquor has been found to be impossible due to the fine wood particles plugging the screens and the resulting uneven distribution of chemical in the wood results in the formation of "bird seed" i.e. incompletely digested particles of wood. In attempting to compensate for the problem normally more chemical is used in sawdust digestion than in chip digestion with a resultant decrease in pulp yield.

BRIEF DESCRIPTION OF THE INVENTION

The present invention provides a method for more uniform impregnation of small chips with sufficient chemical for subsequent cooking preferably in a steam atmosphere.

The present invention eliminates the need for screens for the extraction of recycled impregnation liquor from a pressurized vessel and yet has all the processing advantages found for the aforesaid patent. This allows the use of such materials as sawdust and shavings, pinchips, thin wafers or chips which have been broken down in thickness by passing through an attrition mill. It also allows the production of quality pulp from such materials as board ends, cuttings from furniture, hockey sticks, etc., which cannot be fed through conventional chippers. This later material can then be 'hogged' and then further broken down to small particles by means of a disc mill or the like.

The present invention is particularly suited for small chips and it is contemplated that regular chips may be crushed or otherwise reduced or specially prepared for easy penetration of liquor for use with the present invention.

The fines, pin chips etc. often contained in conventional chips give problems in extraction of the liquor from conventional digesters, particularly continuous digesters. It will be seen that with the present invention such problems (screen plugging) are eliminated and a substantially uniform pulp obtained by adjusting the residence time for proper impregnation.

Broadly the present invention comprises continuously feeding small chips and a cooking chemical containing impregnation liquor at controlled rates into an impregnation zone and maintaining a consistency of no more than 10% (i.e. liquor to wood ratio of no less than 9 to 1) in said zone at a concentration to insure that a substantial excess of cooking chemical is readily available to said small chips, passing said small chips and liquor co-currently through the said impregnation zone, while agitating the chips and liquor to improve the contact between the liquor and the chips, maintaining the residence time of the individual chips in the impregnation zone substantially the same, coordinating the temperature and pressure conditions and residence time of said chips thereby to impregnate said small chips without cooking to substantially soften said chips, separating said impregnated small chips from the portion of said impregnation liquor not sorbed by said chips, returning at least some of said portion to said impregnation zone, introducing said impregnated small chips into a cooking zone, and digesting the said small chips.

Preferably the consistency of the chip liquor mixture will be maintained substantially uniform throughout the impregnation zone by the agitation or mixing action in the zone.

Preferably a water balance will be maintained in the system by regulating the amount of water entering the system.

BRIEF DESCRIPTION OF DRAWINGS

Further features, objects and advantages will be evident from the following detailed description of a preferred embodiment of the present invention taken in conjunction with the accompanying drawing.

DESCRIPTION OF THE PREFERRED EMBODIMENTS

Figure 1:
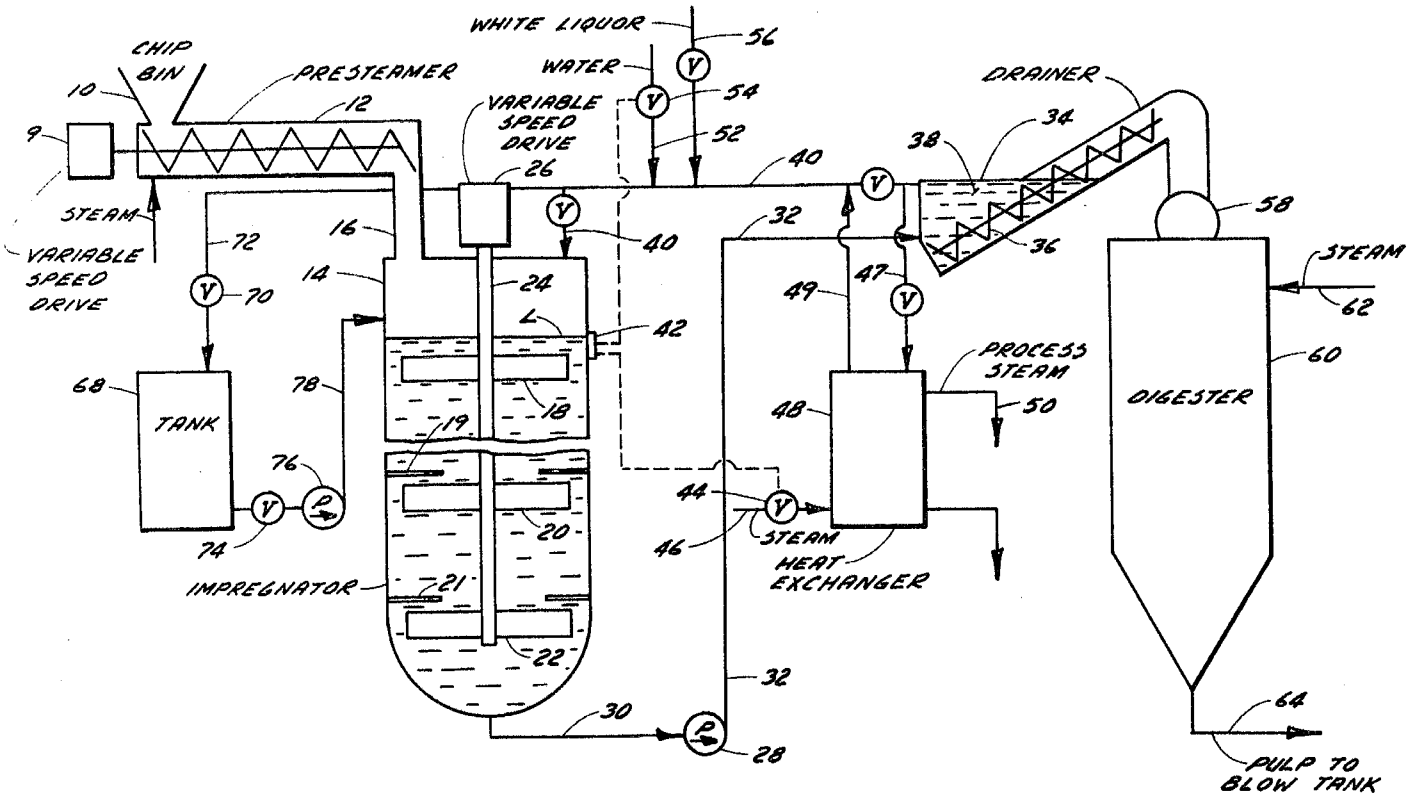
FIG. 1 is a schematic illustration of the process of the instant invention.

Referring to FIG. 1 the basic elements of the present invention comprise a chip bin 10 from which small chips are fed into a pre-steamer 12 which is operated at a controlled speed via metering drive 9 thereby to meter the chips flow to the system. The small chips are steamed at substantially atmospheric pressure in the presteamer 12 and pass from the pre-steamer into the impregnator 14 via down pipe 16.

The impregnator is provided with at least one and preferably with a plurality of stirrers; in the illustrated arrangement three stirrers 18, 20 and 22 have been provided, but the number is dependent on the type of stirrer and size and shape of the impregnation zone 14. The stirrers 18, 20 and 22 are mounted on a shaft 24 which is driven by a variable speed drive 26. Suitable baffles as indicated at 19 and 21 project in from the walls of the vessel between the stirrers to aid in controlling the flow of small chips and liquor. The baffles 19 and 21 divide the impregnation vessel into a plurality of separate interconnected mixing zones wherein the liquor and chips are intimately mixed thereby improving contact between the liquor and chips and facilitating the transfer of chemical from the liquor to the chips. The baffles 19 and 21 and the stirrers or impellers 18, 20 and 22 are designed to obtain lateral mixing of the liquor and chips while insuring that each chip has substantially the same residence time in the impregnator (i.e. the impregnator operates substantially on a first in, first out basis). Suitable equipment to obtain this flow and mixing action is well known for example in the chemical industry i.e. as a plug flow tubular type reactor.

Under stable operating conditions a substantially constant liquid level L is maintained in the impregnator 14.

In the illustrated arrangement a pump 28 draws a mixture of liquor and small chips from the impregnator 14 via Line 30 and pumps this mixture via Line 32 into the drainer 34.

The drainer 34 may take any convenient form, for example, as illustrated it may comprise an inclined screw 36 contained within a housing. The screw 36 lifts the impregnated small chips from the excess impregnation liquor which drains into the zone 38. Alternatively the drainer may take the form of any conventional press adapted to squeeze excess liquor from the small chips.

Excess liquor from the drainer 34 passes via line 40 back into the impregnator 14. If required, a suitable pump (not shown) may be provided for delivering the liquor from the drainer 34 to the impregnator 14. Minor amounts of the fibre may be carried back to the impregnator with the excess liquor but it is preferred to keep these amounts as low as possible.

Fresh chemical is added to the impregnation system via line 56 in an amount sufficient to replace the chemical carried with the small chips into the Digestor 60. To operate the system generally the amount of chemical added via line 56 is co-ordinated with the amount of incoming chips to maintain the required concentration of chemical in the impregnation zone and to regulate the amount of chemical sorbed by the chips.

In operating a continuous system it is important to maintain a water balance in the system. A preferred method of maintaining such a water balance is by passing a portion of the liquor from the drainer 34 via line 47 through a heat exchanger 48 and then back via line 49 to the line 40. The heat applied to the liquor passing through the heat exchanger 48 is controlled by level sensing mechanism 42 sensing the Level L and controlling the valve 44 in the steam line 46 to the heat exchanger 48. Valve 44 is controlled to apply sufficient heat to the liquor passing through the heat exchanger 48 to evaporate a controlled amount of water from the liquor to maintain level L substantially constant as described in the said Canadian patent. The water evaporated from the liquor leaves the system as process steam via line 50.

It is preferred that only a portion of the liquor from the drainer pass through the heat exchanger 48 as it is desired to maintain the temperature in the impregnator 14 below 100° C.

In some cases, e.g. when the small chips are very dry, the liquor level L may tend to decrease as insufficient water is entering the system. Under these circumstances the steam valve 44 is closed and water is added via Line 52 under control of the level senser 42 operating valve 54 to maintain the level L constant.

The impregnated wood particles carrying sufficient chemical for subsequent digestion leave the drainer 34 and pass through a suitable mechanism such as a valve 58 into the digester 60 where they are contacted with direct steam and brought to cooking temperature. The direct steam enters the digestor 60 via line 62 and the cooked pulp leaves via line 64 and is directed to a blow tank or other suitable processing steps.

When it is desired to make a substantial change in production rate it is preferred to temporarily deactivate the automatic water balance controls so that too much water is not added or evaporated to maintain the level L constant.

When such major changes in production rate are instituted, liquor is directed to or from the surge tank 68. For example if the flow rate of chips and the flow rate of fresh chemical are increased to increase production the level L naturally tends to rise. Under these conditions the Valve 70 in the Line 72 leading to the tank 68 in Line 40 is opened to divert some of the flow of liquor into tank 68. This diverted flow continues until feed rates stabilize and then the Valve 70 is closed and level control 42 functions normally to control the steam in the heat exchanger 48 or the additional water via Valve 54. On the other hand if the production rate is decreased the level in the tank tends to fall since less chips and chemical are being introduced. Impregnation liquor is then pumped via pump 76 from the tank 68 through Valve 74 which is opened and line 78 into impregnator 14 to maintain the level L. Pump 76 and the Valve 74 are in operative position until stable feed rates are attained.

The operation of the system of the instant invention is as follows:

The small chips are fed from the chip bin 10 into the pre-steamer 12 where they are steamed at atmospheric pressure to remove air. The small chips drop through the tube 16 into the impregnator 14 and travel with the liquor through the impregnator. The flows of liquor and the small chips through the impregnator are preferably regulated so that both flow together through the impregnator at substantially the same speed i.e. the residence times for the liquor and small chips are substantially the same. These flows may be regulated by the rotation of the paddles 18, 20 and 22 preferably in cooperation with the baffles 19, 21, etc., which limit verticle mixing.

The mixture of impregnation liquor and chips or wood particles is withdrawn from the impregnator 14 and is pumped by pump 28 through line 32 into the drainer 34. Liquor is separated from the chips in the drainer 34 and this separated liquor is returned via line 40 to the impregnator 14. A portion of this separated liquor may be directed through the heat exchanger 48 and a controlled amount of this liquor is evaporated to maintain the water balance as above decribed. Alternatively water may be added via line 52 to maintain the water balance.

Fresh chemical is added to the system via line 56 in an amount coordinated with the amount of small chips fed by the pre-steamer 12 to provide the desired chemical concentration in the impregnation liquor and thereby ensure that the small chips may sorb the required chemical for subsequent digestion and carry this required amount of chemical from drainer 34 into the digestor 60.

The impregnated small chips pass from the drainer 34 via valve 58 into the digestor 60 where they are cooked using the chemical sorbed on the small chips and the resulting pulp is directed to a blow tank or other processing equipment via line 64.

The temperature, pressure and time conditions maintained in the impregnator are preferably set so that the small chips are not significantly digested and retain at least a major portion of their rigidity when they leave the drainer so that they will drain more easily i.e. they are not softened to the extent to make separating excess liquor too difficult. This may be obtained, for example, by maintaining the impregnator at atmospheric pressure and a temperature below 100° C. Retention time in the impregnator will be less than 60 minutes preferably between 10 and 40 minutes and will in part be dependent upon the thickness of the small chips being processed.

The consistency in the impregnator is extremely important as this permits operation with a substantial excess of chemical while maintaining a moderate chemical concentration in the liquor and permits relative motion between the liquor and the chips to insure good equalization of chemical on the chips. The maximum consistency in the impregnator should be less than about 10% i.e. a liquor to wood ratio of no less than 9 to 1 and it is generally preferred that the consistency be within the range of about 5–7%.

The moderate chemical concentration in the impregnation liquor of from about 20 to 50 grams per liter depending on the pulping process used insures that the chips are not damaged by contact with highly concentrated liquor. Even with such a low concentration for example with a Kraft system operating for example at 5% consistency and a chemical concentration in the impregnation liquor of 36.2 grms per liter the percent alkali to wood in the impregnator is about 100%. Bearing in mind that the alkali consumption for such a cook would be in the order of 14%, it will be apparent that about seven (7) times the amount of alkali necessary for the cook is available in the impregnator.

As above indicated, the conditions in the impregnation zone, namely, the temperature, pressure, concentration and consistency are important to the operation of the instant invention. Particularly it is important to make the chemical in the impregnator liquor available in substantially the same proportions to each unit of chips. The differences in specific gravity between the saturated small wood chips and the impregnation liquor and the non-uniformity of the specific gravity of the saturated small chips make it necessary to regulate the flows of chips and liquor through the impregnation zone 14 and insure that the chemical is uniformly available to the chips. Stirrers 18, 20 and 22 (three have been illustrated but fewer or more stirrers may be used depending on the size of the impregnation vessel) add turbulence to the flow of small chips and liquor to insure substantially uniform availability of chemical to the chips. The stirring regulates the flow so that the residence time of the small chips and liquor in the impregnation zone are substantially the same, i.e. the average velocities of impregnation liquor and of the small chips through the impregnation zone will be substantially the same. As above indicated the rotation of the shaft 24 is controlled by the variable speed drive 26 which is manipulated as required to obtain the desired flow conditions or turbulence in the impregnator 14.

As above indicated the high liquor to wood ratio (no lower than 9 to 1%) in the impregnation zone is also important to permit proper mixing of the liquor and chips in the zone. If the liquor ratio is too low, i.e. the consistency is too high, it will be substantially impossible for the impellers to circulate the liquor relative to the chips and proper sorption of chemical uniformly by the chip mass will be inhibited.

It is preferred to mix the liquor with the chips and to maintain a substantially uniform concentration throughout the impregnation zone, however, this is not absolutely essential. Bearing in mind that within the first few minutes of contact with the impregnation liquor the chips sorb about 80% of the chemical it will be apparent that mixing during this initial period is more critical. Mixing and maintaining a uniform consistency throughout the impregnation zone facilitates control of the system and the removal of the impregnated chip and liquor from the impregnator at the same rate as they enter; the dwell time is controllable by the pumping rate of pump 28.

The amount of chemical carried into the digester 60 is partially dependent upon the amount of liquor carried with the wood particles when they leave the drainer 34 and pass into the digester 60 but in any event the particles will carry sorbed thereon sufficient chemical for digestion. It is preferred that the consistency of the mixture entering the digestor be in the range of about 26 to 38%. Significantly higher consistencies may result in difficulty obtaining proper cooking while significantly lower consistencies may result in significant waste of chemical.

Typical digestion conditions are a temperature of 185° C. under pressure of 150 p.s.i. for approximately 20 minutes.

EXAMPLE 1

The following is a specific example of a cook that was carried out in the lab to illustrate the conditions contemplated for use in the present invention.

Soft wood sawdust and shavings were presteamed at 102° C. under a pressure of 2 psig. for 5 minutes and then impregnated at 90° C. for 15 minutes at a consistency of 5%. The composition of the impregnation liquor was 48 grams per liter effective alkali and 38% sulphidity. The thus impregnated small chips were drained to a consistency of about 30% and cooked for 20 minutes at 150 psig.

The resultant pulp had a total yield of 46.3%; an accepted yield of 45.5%; and a rejects of 0.8%. The Kappa number was 33.7%; viscosity 18; and brightness (CPPA absolute #8 filter (32.8.

EXAMPLE 2

Pulp was produced from spruce and balsam sawdust in a continuous experimental digester operating at a daily production rate of approximately 1.5 tons. The sawdust was slurried in a large volume of fortified recycled Kraft liquor and was evenly impregnated with the cooking chemical and after the wood was separated from the excess chemical it was fed to the digester. The resulting pulp was tested and evaluated and the following are details of the conditions for the specific trial.

IMPREGNATION

Sawdust having the following particle size distribution,

Retained on a 6 mesh 21.8%
Retained on a 10 mesh 30.2%
Retained on a 20 mesh 36.4%
Past a 20 mesh 11.6% was fed by a metering screw at a controlled rate to a pre-steamer where is was steamed for 2 minutes at atmospheric pressure to remove air. The conditions for impregnation were as follows:

The feed rate of wood was 4 oven dried pounds per minute. The impregnation liquor had a strength of 36.2 grams per liter effective alkali and was composed of flow of 30 U.S. gallons per minute recycled impregnation liquor at 90° C. with a chemical concentration of 35 grams per liter effective alkali with a sulphidity of 30% together with 0.85 U.S. gallons per minute of white liquor having a chemical concentration of 78.7 grams per liter effective alkali and a sulphidity of 29%.

The chemical pick up on the wood was approximately 14%.

Approximately 2% consistency was maintained in the impregnator which represents a total percent chemical on wood of 233% in the impregnation tower.

The wood and impregnation liquor were mixed as a slurry (at 2% consistency) for 30 minutes at 90° C. in the impregnation tower.

The impregnation tower was 4 feet in diameter, 12 feet high and had 4 mixing stages in series and was open to the atmosphere.

DEWATERING

The impregnated sawdust was separated from the impregnation liquor in a device consisting of a settling tank with an inclined screw bottom. Slurry from the impregnation tower was pumped into the settling tank and the wood settled into the screw while the clear liquor overflowed. The wood was conveyed up the screw and above the liquid level in the tank the excess liquor was returned to the impregnation tower while the separated impregnated sawdust was delivered to the digestion zone.

The screw for the dewatering device is 10 inches in diameter 20 feet long and was inclined at 30 degrees. The screw turned at 8 rpm. so that the wood was in the screw for about 3 minutes and drained to approximately 30% solid content of wood.

The impregnated wood was damp to the touch and was reddish brown in colour however in size and shape and firmness it was almost identical to the sawdust fed to the impregnator.

PULPING

Digester used consists of two Bauer M & D tubes in series. Each tube was 24 inches diameter by 12 feet 6 inches long. Feeding and discharge of the digester was through a 6 inch Bauer rotary valves. The digester was maintained at a pressure to 150 psi and a temperature in the range of 180° to 186° C. Total pulping time was 22 minutes. Liquid (mainly steam and condensate) was continuously removed from the tubes to maintain vapour phase pulping conditions. Liquid withdrawn from the second tube contained 3 to 7 grams per liter effective alkali.

The following table gives the results of the test:

TABLE

| | | | |
|---|---|---|---|
| Cooking Process | Kraft Vapour phase | | |
| Wood | Softwood Sawdust Fibre Fractionation (Clark Classifier) | | |
| | Mesh Size | | |
| | Passed | Retained | % |
| | | 10 | .4 |
| | 10 | 28 | 5.8 |
| | 28 | 48 | 25.6 |
| | 48 | 100 | 13.2 |
| | 100 | | 7.0 |
| Beating Equipment | PFI Mill | | |
| Yield percent | 44.5 | | |
| Kappa number | 30.0 | | |
| CED Viscosity | 13.3 | | |
| Brightness CPPA | 30 | | |

| Canadian Standard Freeness | 550. | 450. | 300. |
|---|---|---|---|
| Bulk (CC/G) | 1.59 | 1.49 | 1.42 |
| Burst Factor | 42. | 49. | 55. |
| Tear Factor | 91. | 84. | 78. |
| Tensile (BL in KM) | 7.8 | 8.6 | 9.3 |
| Percent Elongation | 2.0 | 2.2 | 2.4 |
| M I T Folds | 200. | 500. | 900. |
| Bausch & Lomb Opacity | 94. | 92. | 90. |

Reject level of the pulp produced was less than 1% and it has been found with Kappa numbers in the range 30 to 60 rejects level will be maintained less than about 1%.

In the preceding discussion, the proposed process has been described primarily in terms of its application to the pulping of sawdust and shavings with Kraft liquors. In fact, however, this process could be applied to the pulping of wood from different sources with a variety of cooking chemicals.

For example, liquors such as sodium hydroxide, sodium carbonate, magnesium or sodium bisulfite, or mixtures of sodium carbonate and sodium sulfite may be used as the pulping reagant. A high yield sodium hydroxide or sodium carbonate pulp may be produced by the present invention and followed by a second stage oxygen treatment. The cooking time to achieve these yield levels would be substantially less than those described above (e.g., 5–15 minutes at 150 psig.).

Pulp produced at the 75–80% yield level by the described process with either sodium carbonate alone or with mixtures of sodium carbonate and sodium sulfite as cooking chemicals would make a good pulp for corrugating medium manufacture because of the good liquor impregnation that would be achieved.

The proposed process is also attractive for pulping by bisulfite processes (e.g. Magnefite) because the low temperature in the impregnation stage would minimize the formation of thiosulfate and the loss of sulphur dioxide vapours from the liquor. For these processes, a chemical charge of 8–10% combined $SO_2$ on wood and the digestion times of 2–3 hours at 166° C. are conventionally required to produce chemical pulp. High yield pulps, such as those used in newsprint could be produced with lower chemical charges and shorter times. In these bisulfite methods, it is of particular value to use a vapour phase digestion, in which there is no liquor surrounding the chip, since this liquor is particularly prone to decomposition at digestion temperatures.

Modifications will be evident to those skilled in the art without departing from the spirit of the invention as defined in the appended claims. For example, while the instant invention has been described as a continuous process it will be evident that the impregnation and draining portions of the instant invention may be continuous and the resultant drained and chemically impregnated small chips may be delivered to one or more batch digestors as desired for cooking.

I claim:

1. A method of digesting small chips to produce a chemical wood pulp comprising; presteaming said chips in a presteamer, continuously introducing said presteamed chips and a chemical-containing impregnation liquor into an impregnation zone in an impregnator to form a mixture consisting essentially of all of said chips and impregnation liquor in said impregnator, said mixture having a consistency of less than 10%, said liquor in said mixture containing a substantial excess of said chemical over that required for subsequent digestion of the chips, continuously passing said mixture through said impregnation zone, agitating said mixture substantially throughout said zone during passage of said mixture through said zone thereby to maintain said consistency substantially constant whereby residence time of said chips in said impregnation zone is substantially uniform, continuously withdrawing said mixture from said impregnator after passage through said zone, removing said chips, impregnated with sufficient chemical for subsequent digestion, from excess impregnation liquor, returning at least a portion of said excess liquor to said impregnation zone together with a fortifying amount of cooking chemical, introducing said separated impregnated chips into a cooking zone and digesting said impregnated chips in said cooking zone.

2. A method as defined in claim 1 wherein said agitating maintains said consistency (is) substantially uniform throughout said impregnation zone (and wherein said agitating is applied in a manner to regulate the flow through said zone).

3. A method as defined in claim 1 wherein water enters the impregnator with the chips and with the impregnation liquor, said method further comprising maintaining a water balance by regulating the amount of said water entering the impregnator.

4. A method as defined in claim 2 wherein the concentration of said chemical in said impregnation liquor entering said impregnation zone is in the range of 20 to 50 grams/liter.

5. A method as defined in claim 2 wherein said consistency is between 5% and 7% in said impregnation zone.

6. A method as defined in claim 1 wherein said impregnation zone is at atmospheric pressure and at a temperature of below 100° C.

7. A method as defined in claim 4 wherein said impregnation zone is at atmospheric pressure and at a temperature of below 100° C.

8. A method as defined in claim 1 wherein said cooking of said chips is in a vapour phase.

9. A method as defined in claim 4 wherein said cooking of said chips is in a vapour phase.

10. A method as defined in claim 5 wherein said impregnation zone is at atmospheric pressure and a temperature of less than 100° C. and the concentration of said chemical in said impregnation liquor entering said impregnator is in the range of 40–45 grams per liter.

* * * * *